United States Patent [19]

Blackmore et al.

[11] Patent Number: 4,556,502

[45] Date of Patent: Dec. 3, 1985

[54] LIQUID FABRIC-SOFTENING COMPOSITION

[75] Inventors: Eunice S. Blackmore, Merseyside; Gordon C. Peterson, Cheshire; Gordon J. T. Tiddy, Merseyside, all of England

[73] Assignee: Lever Brothers Company, New York, N.Y.

[21] Appl. No.: 594,616

[22] Filed: Mar. 29, 1984

[30] Foreign Application Priority Data

Apr. 8, 1983 [GB] United Kingdom ..... 8309662

[51] Int. Cl.[4] ..... C11D 1/94; D06M 13/46

[52] U.S. Cl. ..... 252/8.8; 8/137; 252/8.75; 252/357

[58] Field of Search ..... 252/8.8, 357, 8.75

[56] References Cited

U.S. PATENT DOCUMENTS

| | | | |
|---|---|---|---|
| 3,738,996 | 6/1973 | Bloch et al. | 548/354 |
| 3,892,669 | 7/1975 | Rapisarda et al. | 252/8.75 |
| 4,046,706 | 9/1977 | Krezanoski | 252/106 |
| 4,304,932 | 12/1981 | Phillips et al. | 252/544 |
| 4,440,665 | 4/1984 | Mather et al. | 252/356 |
| 4,445,901 | 5/1984 | Beavan et al. | 8/103 |

FOREIGN PATENT DOCUMENTS

| | | |
|---|---|---|
| 77185 | 4/1983 | European Pat. Off. . |
| 1352770 | 5/1974 | United Kingdom . |
| 2031941 | 4/1980 | United Kingdom . |

*Primary Examiner*—A. Lionel Clingman

*Attorney, Agent, or Firm*—Lynne Darcy; James J. Farrell

[57] ABSTRACT

Aqueous concentrated liquid fabric softening compositions contain at least 10%, such as between 20% and 40%, of a cationic fabric softening agent and at least 0.5%, such as between 10% and 20% of a material which is

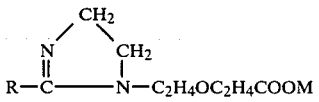

(I)

or

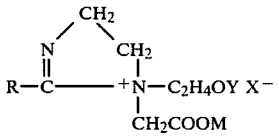

(II)

where R is $C_8$–$C_{22}$ alkyl or alkenyl, M is hydrogen or alkalimetal, Y is hydrogen or —$CH_2COOM$ and $X^-$ is an anion, together with 5–30% of a non aqueous solvent, such as isopropanol. The compositions show good stability without the need for excessive levels of non aqueous solvent.

7 Claims, No Drawings

LIQUID FABRIC-SOFTENING COMPOSITION

The present invention relates to a liquid fabric softening composition. More particularly, it relates to an aqueous concentrated liquid fabric softening composition.

Aqueous liquid fabric softening compositions are well known in the art and are being used nowadays quite commonly in domestic laundering. Most of the present day domestic fabric softening compositions are aqueous dispersions containing from about 3 to 7% of water-insoluble cationic fabric softening agents, as well as a number of additives such as rewetting agents, viscosity modifiers, fluorescers, perfumes, colourants and so on. These products are normally used in the last rinse of a washing process, whereby the fabric fibres take up a certain amount of the active cationic softening agent, resulting in a soft, fluffy feel of the fabric.

These products however often show, in a freeze/-thaw cycle, disadvantages in that they tend to be unstable, resulting in gels or in inhomogenous products.

Furthermore, in view of their low content of active cationic softening agent, and their high water content, substantial amounts have to be dosed in the rinse, which, especially when the washing machine is equipped with a semi-automatic or fully automatic dosing device, requires substantial provisions to cope with these relatively large volumes of products. The high water content makes the packaging costs of these products, in relation to their level of active ingredients, unsatisfactorily high.

As a solution to some of the above problems it has been proposed to prepare more concentrated liquid fabric softening compositions. In view however of the fact that the more active cationic softening agents have a relatively limited solubility in water, and/or tend to gel at higher concentration in water, special measures have to be taken such as the use of more soluble, but less effective cationic softening agents or the use of appreciable amounts of non aqueous solvents, sometimes even up to 40% by weight of solvent in the composition.

It may be desirable to reduce the level of non-aqueous solvents in such products.

Further, it has been proposed to form more concentrated fabric softening compositions from a mixture of cationic fabric softening agent and nonionic surfactants such as ethoxylated alkyl phenols. However, while such nonionic materials may contribute to some extent to softening, it would be desirable to include in the compositions in place of such nonionic materials, agents which will not only improve the dispersibility and dispensability of the products, but will also make a greater contribution towards softening.

It has been proposed in GB No. 2 031 941-A (Albright and Wilson Limited) that concentrated aqueous compositions containing cationic materials can be formed in a low viscosity pumpable liquid state if they also contain an amphoteric surfactant such as a betaine.

Concentrated fabric softening compositions containing a cationic fabric softener and a cationic cosurfactant have been described in FR No. 2 451 960 (Roche).

We have discovered that by the use of specific amphoteric cosurfactants with the water-insoluble cationic fabric softening agent, the level of non-aqueous solvents in such products can be reduced while maintaining acceptable dispersibility of the products in water and acceptable dispensability of the product in automatic dosing machines while the specific cosurfactants make a contribution towards softening.

Thus, according to the invention, there is provided a liquid concentrated fabric softening composition comprising (i) at least 15% by weight water;

(ii) at least 10% by weight of one or more water-insoluble cationic fabric softening agents;

(iii) from 5% to 30% non-aqueous solvent; and (iv) at least 0.5% of an amphoteric cosurfactant, characterised in that said amphoteric cosurfactant is a material having the general formula

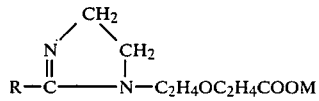

(I)

or a material having the general formula

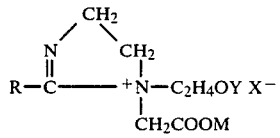

(II)

where R is an alkyl or alkenyl group having from 8 to 22 carbon atoms, M is a hydrogen or an alkali metal, Y is hydrogen or $—CH_2COOM$ and $X^-$ is a monovalent anion.

The water-insoluble cationic fabric softener can be any fabric-substantive cationic compound and has a solubility in water at pH 2.5 and 20° C. of less than 10 g/l. Highly preferred materials are quaternary ammonium salts having two $C_{12}$–$C_{24}$ alkyl or alkenyl chains, optionally substituted or interrupted by functional groups such as —OH, —O—, —CONH, —COO—, etc. The level of the water-insoluble cationic fabric softener in the product is at least 10%, preferably from 20% to 60% by weight.

Well known species of substantially water-insoluble quaternary ammonium compounds have the formula

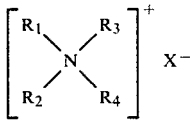

(III)

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow)dimethyl ammonium methyl sulfate; dihexadecyl diethyl ammonium chloride; di(-coconut alkyl)dimethyl ammonium chloride. Ditallow dimethyl ammonium chloride, di(hydrogenated tallow alkyl)dimethyl ammonium chloride, di(coconut alkyl)-dimethyl ammonium chloride and di(coconut alkyl)-dimethyl ammonium methosulfate are preferred.

Another class of preferred water-insoluble cationic materials are the alkylimidazolinium salts believed to have the formula:

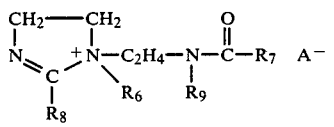

(IV) N wherein $R_6$ is an alkyl or substituted alkyl group containing from 1 to 4, preferably 1 or 2 carbon atoms, $R_7$ is an alkyl or alkenyl group containing from 9 to 25 carbon atoms, $R_8$ is an alkyl or alkenyl group containing from 8 to 25 carbon atoms, and $R_9$ is hydrogen or an alkyl group containing from 1 to 4 carbon atoms and $A^-$ is an anion, preferably a halide, methosulfate or ethosulfate. Preferred imidazolinium salts include 1-methyl-1-(tallowylamido-)ethyl-2-tallowyl-4,5-dihydroimidazolinium methosulfate and 1-methyl-1-(Palmitoylamido)ethyl-2-octadecyl-4,5-dihydroimidazolinium chloride. Other useful imidazolinium materials are 2-heptadecyl-1-methyl-1-(2-stearylamido)ethyl-imidazolium chloride and 2-lauryl-1-hydroxyethyl-1-oleyl-imidazolinium chloride. Also suitable herein are the imidazolinium fabric softening components of U.S. Pat. No. 4,127,489, incorporated by reference.

Cosurfactants of the general formula (I) above include Crodateric CY wherein R=caprylic and M=hydrogen, Crodateric CYNA which is the corresponding sodium salt, Crodateric C wherein R=coconut alkyl and M=hydrogen, Crodateric S wherein R=stearyl and M=hydrogen and Crodateric O wherein R=oleyl and M=hydrogen. These materials are available from Croda Inc.

Cosurfactants of the general formula (II) above include the Miranol series of materials available from Miranol Chemical Co Inc. When $Y=CH_2COOM$ and M=Na, such materials include Miranol C2M-SF (R=tall oil alkyl) and Miranol H2M (R=lauric). When Y=H and M=Na, such materials include Miranol SM (R=capric).

The level of the amphoteric cosurfactant in the product is at least 0.5%, preferably 5 to 30% by weight.

It is preferred to use the cosurfactants in acid form rather than in salt form, in which case the cosurfactants in salt form can be pretreated with an ion-exchange resin such as Amberlite MB3.

Further, for optimum performance it is preferred to use a mixture of cosurfactants with different alkyl chain lengths, in particular a mixture of a first cosurfactant having an alkyl chain length above 15 with a second cosurfactant having an alkyl chain length below 15 in a weight ratio between about 4:1 and about 1:4, especially between about 2:1 and about 1:2.

The weight ratio of the softener to the cosurfactant preferably lies within the range of about 1:1 to about 8:1, most preferably within the range of about 2:1 to 5:1.

Non-aqueous solvents which can be used in the compositions of the invention include $C_1$-$C_4$ alkanols and polyhydric alcohols such as ethanol, iso-propanol and ethylene glycol. The level of these solvents in the compositions should be from 5% to 30%, preferably from 10% to 20%. Commercially available fabric softeners and cosurfactants will generally contain a certain amount of such solvents, and this amount should be taken into account. In some cases it may not be necessary to add any further solvent.

It is preferred that the level of any non-aqueous solvent in the composition will be not more than the level of water therein.

The compositions may also contain one or more optional ingredients selected from pH buffering agents such as weak acids eg phosphoric, benzoic or citric acids (the pH of the compositions are preferably less than 6.0), electrolytes, such as sodium chloride and calcium chloride, rewetting agents, viscosity modifiers, emulsifiers (such as soluble cationic and/or nonionic surfactants of the type disclosed in European Patent Application No. 18039), dispersion aids, antigelling agents, perfumes, perfume carriers, fluorescers, colourants, hydrotropes, antifoaming agents, antiredeposition agents, enzymes, optical brightening agents, opacifiers, stabilisers such as guar gum and polyethylene glycol, anti-shrinking agents, anti-wrinkle agents, fabric crisping agents, spotting agents, soil-release agents, preservatives, dyes, bleaches and bleach prcursors, drape imparting agents and antistatic agents.

Electrolytes are generally detrimental to the stability of the products if added in excess amounts unless they serve as hydrotropes. It is therefore preferred to add no more than 2% by weight, preferably less than 0.5% by weight electrolyte.

The compositions of the invention must contain at least 15% water, most preferably from 30% to 75% by weight water. Where the water content falls below 15% by weight, stability of the product cannot be ensured.

The compositions according to the invention may be made by a variety of methods. A preferred method is to melt the fabric softener and the cosurfactant together, disperse this molten mixture in water at an elevated temperature, add the further solvent, electrolyte and other optional ingredients and then allow the mixture to cool. Alternatively, especially where the starting ingredients are already in the form of liquid dispersions, the ingredients may be mixed cold in any order.

The invention will now be illustrated by the following non-limiting examples in which parts and percentages are by weight unless otherwise specified. Where components are referred to by their Commercial names, the percentages quoted are percentages of active material.

EXAMPLE 1

Compositions were prepared according to the following formulations:

| | |
|---|---|
| A. Adogen 470 (di-soft tallow alkyl dimethyl ammonium chloride) | 20% |
| Crodateric CY | 20% |
| Isopropyl alcohol* | 7% |
| Water (demineralised) | balance to 100% |

*From raw materials - no further solvent added.

| | |
|---|---|
| B. Adogen 470 | 25% |
| Crodateric S | 10% |
| Isopropyl alcohol* | 18% |
| Water | balance to 100% |

*From raw materials.

| | |
|---|---|
| C. Arquad 2C (di-coconut alkyl dimethyl ammonium chloride) | 20% |
| Crodateric CYNA | 10% |
| Isopropyl alcohol* | 6% |
| Water | balance to 100% |

*From raw materials.

| | |
|---|---|
| D. Varisoft 475 (di-soft tallow imidazolinum methosulphate) | 20% |
| Crodateric O | 20% |
| Isopropyl alcohol* | 12% |
| Water | balance to 100% |

*From raw materials.

| | |
|---|---|
| E. Varisoft 3690 (di-oleyl imidazolinium methosulphate) | 40% |
| Crodateric C | 10% |
| Isopropyl alcohol* | 22% |
| Water | balance to 100% |

*From raw materials.

| | |
|---|---|
| F. Varisoft 475 | 20% |
| Crodateric CY | 20% |
| Isopropyl alcohol* | 5% |
| Sodium chloride | 2% |
| Water | balance to 100% |

*From raw materials.

| | |
|---|---|
| G. Adogen 470 | 29.4% |
| Crodateric S | 14.7% |
| Isopropyl alcohol* | 25.0% |
| Sodium chloride | 0.2% |
| Water | balance to 100% |

*From raw materials.

| | |
|---|---|
| H. Arquad 2HT (di-hardened tallow dimethylammonium chloride) | 20.0% |
| Crodateric O | 5.0% |
| Crodateric C | 5.0% |
| Isopropyl alcohol** | 15.0% |
| Water | balance to 100% |

**Part from raw materials and part added.

EXAMPLE II

Compositions according to the following formulations were prepared and were tested for (i) dispersibility/dispensability and (ii) softness.

| Example No<br>Ingredients (%) | 2A | 2B | 2C | 2D |
|---|---|---|---|---|
| Varisoft 475 | 40 | 40 | 40 | 40 |
| Crodateric O | — | 10 | — | 5 |
| Crodateric CY | — | — | 10 | 5 |
| Nonylphenol 10EO | 10 | — | — | — |
| Isopropyl alcohol (additional) | 10 | 10 | 10 | 10 |
| Dispersibility/ Dispensability | Poor | Poor | Poor | Quite good |
| Softening properties | Poor | Very good | Quite good | Good |

EXAMPLE III

Compositions were prepared according to the following formulations:

| | |
|---|---|
| A. Varisoft 475 | 40.0% |
| Miranol C2M-SF** | 7.8% |
| Isopropyl* | 10.0% |
| Water | balance to 100% |

*8% from Varisoft 475, plus 2% added
**treated initially with Amberlite MB3

| | |
|---|---|
| B. Varisoft 475 | 30.0% |
| Miranol SM** | 6.2% |
| Isopropyl alcohol | 15.0% |
| Water | balance to 100% |

*6% from Varisoft 475, plus 9% added
**treated initially with Amberlite MB3

Both of the above formulations resulted in products which had a low viscosity, were acceptably stable, did not separate on dilution and dispersed acceptably.

EXAMPLE IV

Compositions were prepared according to the following formulations:

| | |
|---|---|
| A. Varisoft 475 | 30.0% |
| Crodateric S | 1.9% |
| Crodateric C | 5.6% |
| Isopropyl alcohol* | 15.0% |
| Water | balance to 100% |

*From raw materials and part added.

| | |
|---|---|
| B. Varisoft 475 | 40.0% |
| Crodateric O | 5.0% |
| Miranol C2M-ST | 5.0% |
| Isopropyl alcohol* | 20.0% |
| Water | balance to 100% |

*From raw materials and part added.

| | |
|---|---|
| C. Varisoft 475 | 40.0% |
| Miranol L2M-SF | 7.5% |
| Miranol S2M-SF | 2.5% |
| Isopropyl alcohol* | 20.0% |
| Water | balance to 100% |

*From raw materials and part added.

These formulations yielded products which had low viscosity and were acceptably stable.

EXAMPLE V

The following Example illustrates the benefit of the amphoteric materials of the present invention over other known amphoteric materials.

Compositions according to the following formulations were used at a concentration in water equivalent to a total active concentration of 50 ppm to rinse terry towelling test cloths in a laboratory scale TERGOTOMETER (Trade Mark) apparatus. The test cloths were rinsed for five minutes at room temperature, after which they were line-dried in a heated cabinet. The softness of the test cloths was then assessed. The formulations and results were as follows:

| Example No | Va | Vb | Vc | Vd |
|---|---|---|---|---|
| Varisoft 475[1] (ex Sherex) | 30% | 30% | 30% | 40% |
| Miranol L2M-SF | 10% | — | — | — |
| Cetyl betaine[2] | — | 10% | — | — |
| Crodateric S | — | — | 10% | — |
| Isopropylalcohol (from raw materials) | 8% | 8% | 17% | 10.5% |
| Water | | | balance | |
| Softness | good | poor | average | average |

Notes:

[1]A cationic fabric softener which is approximately ditallow imidazolinium methosulphate

[2]A compound of the formula R $N(CH_3)_2.CH_2COOH$ where R = cetyl

These results demonstrate the benefit of using the amphoteric materials of the invention over alternative amphoteric materials.

EXAMPLE VI

Using the same test method as described in Example V, a number of formulations were tested for softness, to demonstrate the most beneficial cationic to amphoteric ratio. The formulations and results were as follows.

| Example No | VIa | VIb | VIc | VId | VIe |
|---|---|---|---|---|---|
| Varisoft 475 (ex Sherex) | — | 10% | 20% | 30% | 40% |
| Crodateric S | 40% | 30% | 20% | 10% | — |
| Isopropylalcohol (from raw materials) | 36% | 29.5% | 23% | 17% | 10.5% |
| Water | | | balance | | |
| Softness | very poor | average | good | very good | average |

These results demonstrate that where the ratio of cationic fabric softening agent to amphoteric cosurfactant lies between 2:1 and 5:1 by weight (Example VId), softening performance is better than at other ratios.

We claim:

1. A liquid concentrated fabric softening composition having both good fabric softening properties and good dispersability/dispensability comprising:
   (i) at least 15% by weight water;
   (ii) at least 10% by weight of one or more water-insoluble cationic fabric softening agents;
   (iii) from 5% to 30% non-aqueous solvent comprising an alcohol selected from the group consisting essentially of $C_1$–$C_4$ alkanols and polyhydric alcohols and mixtures thereof;
   (iv) at least 0.5% of a mixture of two amphoteric surfactants, characterized in that said amphoteric surfactants are materials having the general formula

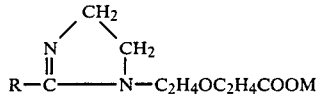

where M is a hydrogen or an alkali metal, and for one such amphoteric surfactant R is an alkyl or alkenyl group having from 8 to 15 carbon atoms and for the other such amphoteric surfactant R is an alkyl or alkenyl group having from 16 to 22 carbon atoms.

2. A composition according to claim 1, characterised in that it contains from 20% to 60% by weight of said one or more cationic fabric softening agents and from 5% to 30% by weight of said amphoteric surfactants.

3. A composition according to claim 1, characterised in that the weight ratio of the cationic softening agent to the surfactants lies within the range of 2:1 to 5:1.

4. A composition according to claim 1, wherein the weight ratio of said amphoteric surfactants to each other is from 1:4 to 4:1.

5. A liquid concentrated fabric softening composition having both good fabric softening properties and good dispersability/dispensability comprising:
   (i) at least 15% by weight water;
   (ii) at least 10% by weight of one or more water-insoluble cationic fabric softening agents;
   (iii) from 5% to 30% non-aqueous solvent comprising an alcohol selected from the group consisting essentially of $C_1$–$C_4$ alkanols and polyhydric alcohols, and mixtures thereof; and
   (iv) at least 0.5% of a mixture of two amphoteric surfactants, characterised in that said amphoteric surfactants are materials having the general formula

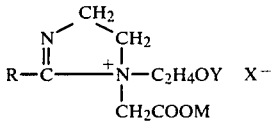

where M is a hydrogen or an alkali metal, Y is hydrogen or $—CH_2COOM$ and $X^-$ is a monovalent anion and for one such amphoteric surfactant R is an alkyl group having from 8 to 15 carbon atoms and for the other such amphoteric surfactant R is an alkyl group having from 16 to 22 carbon atoms, the weight ratio of such amphoteric surfactants to each other being from 1:4 to 4:1.

6. A composition according to claim 5, characterised in that it contains from 20% to 60% by weight of said one or more cationic fabric softening agents and from 5% to 30% by weight of said amphoteric surfactants.

7. A composition according to claim 5, characterised in that the weight ratio of the cationic softening agent to the surfactants lies within the range of 2:1 to 5:1.

* * * * *